United States Patent [19]

Wihlke

[11] 4,447,973

[45] May 15, 1984

[54] ALBUM LEAF WITH POCKETS FOR INSERTION OF PHOTOGRAPHIC PAPER PRINTS AND SIMILAR ARTICLES

[76] Inventor: Hans Wihlke, Strömkarlsvägen 57, S-161 38 Bromma, Sweden

[21] Appl. No.: 51,859

[22] Filed: Jun. 25, 1979

[30] Foreign Application Priority Data

Jun. 30, 1978 [SE] Sweden ..... 7807440

[51] Int. Cl.[3] ..... G09F 1/10

[52] U.S. Cl. ..... 40/159; 40/405; 40/537

[58] Field of Search ..... 40/159, 537, 405

[56] References Cited

U.S. PATENT DOCUMENTS

| | | | |
|---|---|---|---|
| 3,596,393 | 8/1971 | Lithgow | 40/159 |
| 3,651,591 | 3/1972 | Woodyard | 40/537 |

FOREIGN PATENT DOCUMENTS

| | | | |
|---|---|---|---|
| 314471 | 4/1974 | Austria | 40/159 |
| 871138 | 3/1953 | Fed. Rep. of Germany | 40/405 |
| 1043280 | 8/1954 | Fed. Rep. of Germany | 40/405 |
| 1134991 | 4/1957 | France | 40/405 |
| 1038621 | 8/1966 | United Kingdom | 40/405 |

*Primary Examiner*—Gene Mancene
*Assistant Examiner*—James R. Hakomaki
*Attorney, Agent, or Firm*—Wigman & Cohen

[57] ABSTRACT

An album leaf with insertion pockets for mounting of planar rectangular articles and comprising at least two superimposed layers of especially plastic, the lower or intermediate layer being opaque while the other layer or layers being transparent, the layers being joined together along the peripheral leaf edges and along frame lines defining the article pockets, the album leaf having a horizontally oriented rectangular format with a margin along one of the short sides of the leaf for binding purposes, the leaf with reference to the binding margin being symmetric relative to the longitudinal center axis of the binding margin, so that the leaf may be turned around said axis and the leaf having a length on the short side being substantially at least equal to the sum of the length of one short and one long side of an article, while having a length on the long side being substantially equal to twice the length of the article on the long side. According to the invention, one article pocket frame line extends parallel to the long sides of the leaf and is spaced from one of the long sides of the leaf a distance substantially corresponding to the length of the short side of an article, while a further frame line running parallel to the other of the long leaf sides and spaced the same distance therefrom, extends from a frame line defining the binding margin on the short leaf side, respectively, along only a short distance substantially corresponding to the difference between the lengths of the short and long sides of an article.

9 Claims, 9 Drawing Figures

(12)
11
14
14
14
14
13a'
13a'
13b'
13b'
13d'
13d'
17'
18
15
16
16
16
16
10'

ALBUM LEAF WITH POCKETS FOR INSERTION OF PHOTOGRAPHIC PAPER PRINTS AND SIMILAR ARTICLES

BACKGROUND AND SUMMARY OF THE INVENTION

The present invention refers to an album leaf with insertion pockets for mounting of photographic paper prints and similar planar rectangular articles in albums, said leaf comprising at least two superimposed layers of suitable material, especially plastic, the lower or intermediate layer being opaque while the other layer or layers being transparent, the layers being joined together along the peripheral edges of the leaf and along frame lines defining the article pockets, the album leaf having a horizontally oriented rectangular format with a margin along one of the short sides of the leaf for binding purposes, the leaf with reference to the binding margin being symmetric relative to the longitudinal centre axis of the leaf, so that the leaf may be turned over about said axis and the leaf having a length of the short side being substantially at least equal to the sum of the length of one short and one long side of an article, while having a length on the long side being substantially equal to twice the length of the article on the long side.

Album leaves of this kind recently have come into more frequent use. The work with mounting of the paper prints is reduced, namely, in said kind of album leaves to only a pure insertion of the prints in the various pockets, which of course is found to be much more attractive than the previous glueing method which was both time-consuming and messy. Many different detail embodiments of such album leaves also have been suggested but they have all suffered from a substantial drawback, namely in that with a rectangular format of the prints and a corresponding shape of the pockets it has only been possible to mount the prints in one single position. Most often one has then chosen the position in which the print has its long side lying horizontally. This format undeniably seems to be the one which most frequently is used when taking pictures on rectangular negatives, but when pictures are taken in upright format they thus must be mounted lying in one or the other direction. When looking upon said pictures it will obviously be cumbersome to turn the album repeatedly in one or the other direction for looking upon the pictures. Many persons also find it aestethically disturbing that all pictures are mounted closely adjacent each other and parallel and all oriented in the same direction. It gives namely a much more living and attractive impression when pictures of the most conventional horizontally oriented format are mixed with correctly turned, i.e. standing upright format pictures on the album pages.

The main object of the present invention therefore is to provide an album leaf of the afore-mentioned kind in which the above-stated drawbacks are eliminated. In accordance with the invention this is achieved substantially in that one article pocket frame line extends parallel to the long sides of the leaf and is spaced from one of said long sides a distance substantially corresponding to the length of a short side of an article, while a further frame line running parallel to the other of the long leaf sides and being spaced the same distance therefrom, extends from a frame line defining the binding margin on the short leaf side, respectively, along only a short distance substantially corresponding to the difference between the lengths of the short and long side of an article, so that in the two pockets thus formed, there is allowed a free choice of mounting articles in either an upright or a horizontally oriented position. In the case where the leaf consists of three layers, the frame lines on either side of the intermediate layer are located strictly opposite each other and the outer layers are cut or scored parallel to the binding margin at a distance therefrom corresponding to the length of the long side of an article.

Owing to the above-stated character of the second frame line so as to only consist of the two short portions, one at each end of the leaf, there is now provided a possibility to freely select a standing or horizontally oriented position of the pictures in the pockets on one side of the longitudinal centre axis of the leaf. After turning the whole leaf over about said axis the upright or standing pictures can be located uppermost with horizontally oriented pictures below but also other mounting variations are possible as will be evident from the following.

BRIEF DESCRIPTION OF THE DRAWINGS

By way of example, the invention will be further described below with reference to the enclosed drawings, on which.

DETAILED DESCRIPTION OF THE PREFERRED EMBODIMENTS

Figure 1:
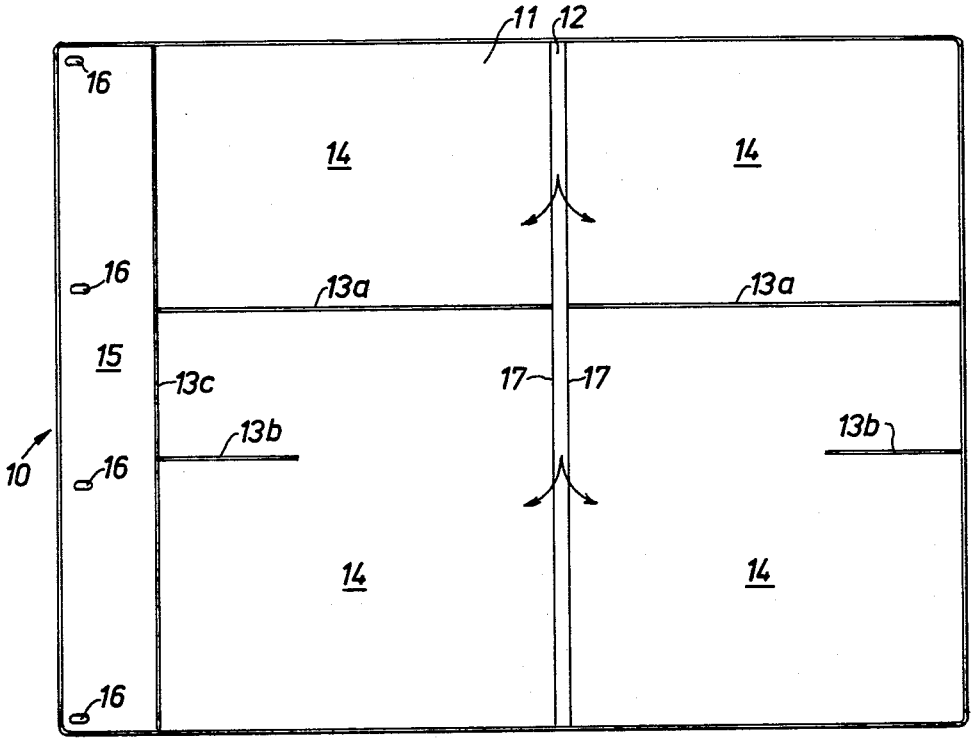
FIG. 1 is a planview of an album leaf according to the invention and adapted for a first standard picture or print size, FIGS. *2a–g* illustrate the seven mounting variations which can be obtained with the inventive album leaf.

In FIG. 1 of the drawings, there is illustrated an album leaf 10 of insert type and comprising at least two and preferably three mutually superimposed layers denominated 11 and 12. The layers are made of suitable material, particularly plastic, and the lowermost or intermediate layer 12 is preferably opaque and white while the other layer or layers 11 are transparent. The layers 11, 12 are joined together in a suitable way, preferably by welding along the peripheral edges of the leaf but also along frame lines 13 defining article pockets 14. The leaf 10 has a rectangular format and is, at one of the short sides, provided with a margin 15 for binding or mounting of the leaf, for instance, in an album.

According to the invention, the outer or uppermost layer or layers 11 are cut or scored parallel to the binding margin 15 spaced at a distance therefrom substantially corresponding to the length on a long side of an article, particularly photographic paper prints, which are to be mounted in the pockets. The mounting of the prints thus is carried out from the vertical centre axis of the leaf and horizontally toward either short side of the leaf.

According to the invention shown in FIG. 1, the leaf 10 is with reference to the binding margin 15 symmetric relative to the longitudinal centre axis A—A of the leaf. Eventual binding means, such as holes 16 or the like, are provided in the margin 15. The leaf 10 may be turned over about said axis for a purpose which will be further explained below. Furthermore, the leaf 10 is dimensioned such that the length of its short side is substantially equal to the sum of the length of one short and one long side of an article to be mounted in the pockets 14, while its long side length is substantially equal to twice the long side lengths of the article 14 added to the width of the binding margin 15.

A frame line 13*a* of the article pockets 14 extends parallel to one of the long sides of the album leaf 10 spaced therefrom a distance substantially corresponding to the short side length of the article. A further frame line 13*b* runs parallel to the other of the long leaf sides and is spaced the same distance therefrom. One frame line 13*b* extends from a frame line 13*c* defining the binding margin 15 and another frame line 13*b* extends from the opposite frame line 13*c* on the other short leaf side along a short distance substantially corresponding to the difference between the short and long side lengths of an article. As is evident from the drawing, this arrangement of frame lines allows a free choice of standing or horizontally oriented placement of the prints or pictures in the two lower portions 14 as illustrated in FIG. 1 owing to the fact that the frame lines 13*b* are two short portions. In case the leaf is composed of three layers 11, 12 it can be turned over, according to the invention, about its longitudinal centre axis A—A, so that these pockets 14, adapted for freely selectable mounting placement of the prints, will be located uppermost.

Figure 2E:
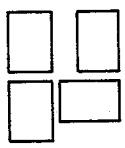
Figure 2F:
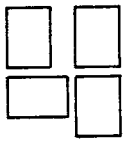
Figure 2G:
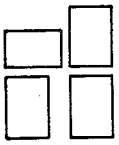
Figure 2A:
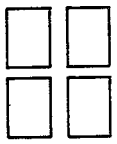
Figure 2B:
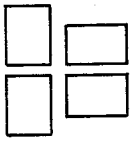
Figure 2C:
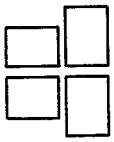
Figure 2D:
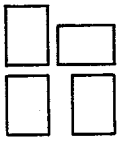

To sum up, this implies that seven different location variants can be provided for four rectangular articles, particularly paper prints of photographic pictures, such as is illustrated more in detail in FIGS. 2*a–g*. For example, in FIG. 2*a*, there can be four pictures mounted in a horizontally oriented position. Or, as shown in FIGS. 2*b*, 2*d*, and 2*e*, one or two pictures may be mounted in a standing or on upright location in the lower half of the leaf while the rest of the pictures are in horizontally oriented position. Also, as shown in FIGS. 2*c*, 2*f*, and 2*g*, when the leaf is turned over about its longitudinal centre axis A—A, one or two pictures may be mounted in a standing or an upright location in the upper half of the leaf while the rest of the pictures are in a horizontally oriented position. This provides for the often very desirable alternation of the mounting location of the pictures which alternation has not been possible to obtain with album leaves hitherto known.

Figure 3:
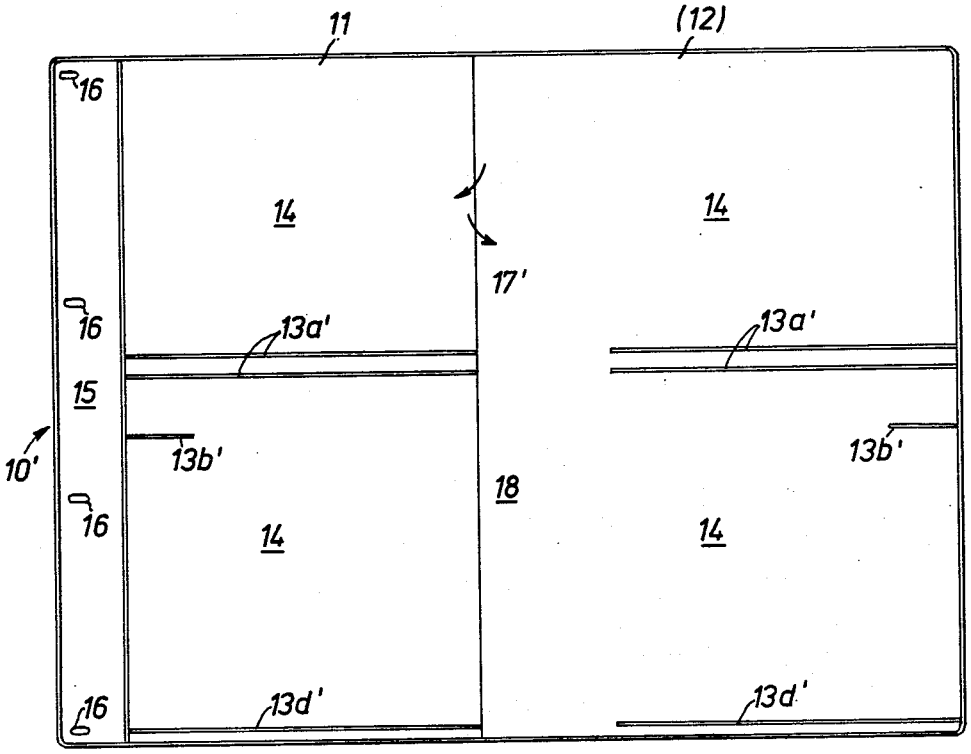
FIG. 3 is a plan view similar to FIG. 1 but illustrating an embodiment particularly adapted for a slightly different standard picture or print size, commercially called "pocket" size (i.e., for cameras in Sweden called "Pocket"-type).
Figure 1:
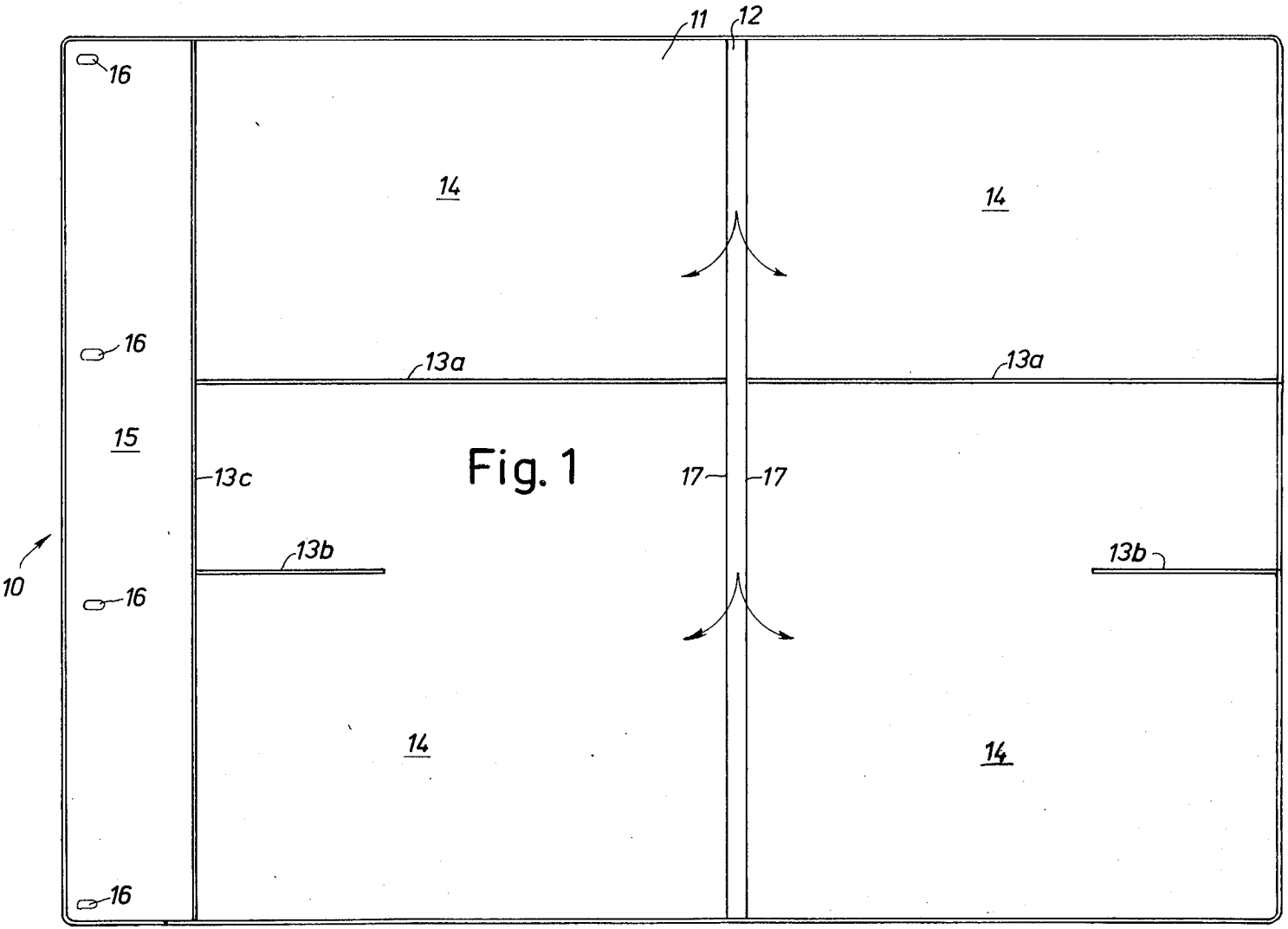
Figure 2E:
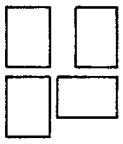
Figure 2F:
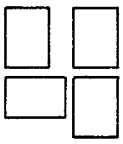
Figure 2G:
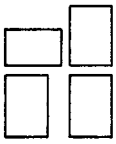
Figure 2A:
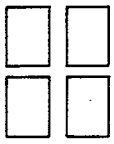
Figure 2B:
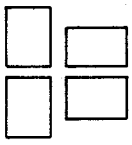
Figure 2C:
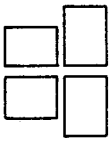
Figure 2D:
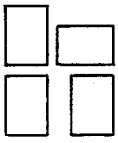
Figure 3:
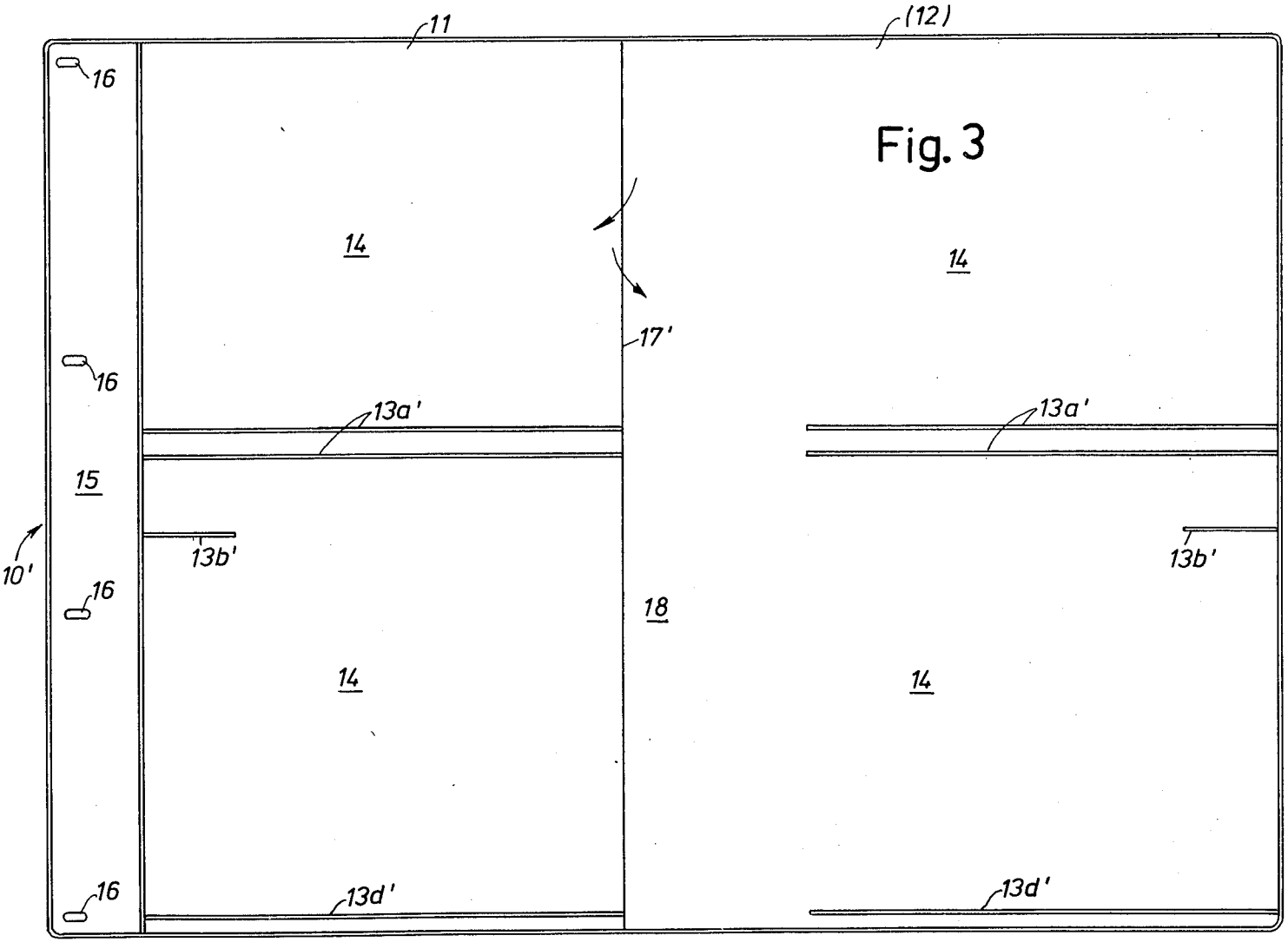

While the album leaf 10 illustrated in FIG. 1 has been especially dimensioned for standard prints from negatives of 35 mm width, said prints having the size 9 cm×12.5 cm, in FIG. 3, there is illustrated a slightly modified leaf embodiment particularly adapted for paper prints made from film negatives from so-called "pocket cameras". Said paper prints usually have the size 9 cm×11.5 cm and, while giving the leaf 10' of said modified embodiment an external peripheral size similar to the leaf 10 of the embodiment according to FIG. 1, the somewhat shorter length of the long sides of the prints might call for a somewhat reduced length of the further parallel frame line 13*b'* but, otherwise, the leaf is substantially unchanged. To be sure that the prints are kept in correct location in the pockets it might be advantageous, however, to double the first frame line 13*a'* and also to add a bottom frame line 13*d'* slightly spaced above the bottom edge of the leaf 10. While a short strip might be removed from the uppermost outer layer 11 in the embodiment according to FIG. 1 so as to leave two layer edges 17, between which the insertion of the pictures or prints into the pockets conveniently can be carried out, only one score line or cut 17' is made in the layer 11 in the FIG. 3 embodiment. Between the articles or prints in their mounted position will be left a free area 18 which can be used for insertion of a strip of paper or the like, on which a description of the contents of the respective prints or articles may be made, if desired.

The foregoing preferred embodiments are considered as illustrative only. Certain modifications and changes will readily occur to those skilled in the art and are intended to be within the scope and spirit of the appended claims.

What I claim is:

1. An album leaf for mounting of a photographic paper print or a similar planar rectangular article comprising:

at least two superimposed layers being joined together along peripheral edges thereof, the outer layer being transparent;

at least one pocket means for inserting the print or the similar rectangular article therein;

frame means for defining said at least one pocket means; and restriction means, extending partially into said at least one pocket means, for limiting selectable mounting therein of the print or the similar rectangular article to one of a standing upright position and a horizontally oriented position;

said restriction means extends a distance corresponding substantially to a difference between lengths on a long side and on a short side of the print or the similar rectangular article.

2. The album leaf, according to claim 1, wherein:

said restrictions means is spaced from one of the frame means a distance corresponding substantially to the length of the short side of the print or the similar rectangular article.

3. The album leaf, according to claim 1, wherein:

said restriction means leaves a free area in said at least one pocket means when the print or the similar rectangular article is mounted in its selected position so that there may be inserted in the free area a strip of paper or the like for describing contents of the print or the similar rectangular article.

4. The album leaf, according to claim 3, wherein:

said restriction means is arranged in said at least one pocket means so that the horizontally oriented position for the print or the similar rectangular article is located along one of an upper and a lower one of said frame means.

5. The album leaf, according to claim 4, wherein:

said horizontally oriented position for the print or the similar rectangular article is relocated along an opposite one of an upper and a lower one of said frame means when the leaf is turned over.

6. The album leaf, according to claim 3, further including a second pocket means, including frame and restriction means, the openings of said first and second pocket means being in opposed adjacent relationship to each other.

7. The album leaf, according to claim 6, further including first and second rectangular pocket means having openings in opposed adjacent relationship to each other, each of said openings of all of said pocket means being located on a common axis line dividing said album leaf.

8. The album leaf, according to claim 6, including an identical arrangement of pocket means, frame means and restriction means on the opposite side of said leaf, whereby each of said leaves include eight pocket means for receiving and viewing a plurality of prints or similar rectangular articles.

9. An album leaf for mounting of a photographic paper print or a similar planar rectangular article comprising:

at least two superimposed layers being joined together along peripheral edges thereof, the outer layer being transparent;

at least one pocket means for inserting the print or the similar rectangular article therein;

frame means for defining said at least one pocket means; and restriction means, extending partially into said at least one pocket means, for limiting selectable mounting therein of the print or the similar rectangular article to one of a standing upright position and a horizontally oriented position;

said restriction means extends a distance corresponding substantially to a difference between lengths on a long side and on a short side of the print or the similar rectangular article;

said restriction means is a welded line which runs substantially parallel to one of the frame means.

* * * * *